US007784900B2

(12) United States Patent
Naruse

(10) Patent No.: US 7,784,900 B2
(45) Date of Patent: Aug. 31, 2010

(54) IMAGING APPARATUS

(75) Inventor: Shinichiro Naruse, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 946 days.

(21) Appl. No.: 11/604,978

(22) Filed: Nov. 28, 2006

(65) Prior Publication Data

US 2007/0126787 A1 Jun. 7, 2007

(30) Foreign Application Priority Data

Dec. 1, 2005 (JP) ..... 2005-347458

(51) Int. Cl.
*B41J 23/00* (2006.01)

(52) U.S. Cl. ..... 347/37

(58) Field of Classification Search ..... 347/37; 400/154.2

See application file for complete search history.

(56) References Cited

U.S. PATENT DOCUMENTS 5,779,376 A * 7/1998 Seu ..... 400/335
7,611,224 B2 * 11/2009 Tsuyama ..... 347/37
2005/0146554 A1 7/2005 Asanuma et al.
2005/0194730 A1 9/2005 Nishida et al.
2005/0265749 A1 12/2005 Asanuma et al.
2006/0146106 A1 7/2006 Naruse

FOREIGN PATENT DOCUMENTS

JP 405085004 A * 4/1993 ..... 347/37
JP 2003-358134 12/2000
JP 2001-071463 * 3/2001

OTHER PUBLICATIONS

U.S. Appl. No. 11/441,857, filed May 26, 2006.
U.S. Appl. No 11/441,857, filed May 26, 2006, Naruse.

* cited by examiner

*Primary Examiner*—Shih-wen Hsieh
(74) *Attorney, Agent, or Firm*—Cooper & Dunham LLP

(57) ABSTRACT

An imaging apparatus is disclosed that includes a carriage that moves back and forth along the main scanning direction, plural recording heads mounted on the carriage that discharge recording liquid, a guide that guides the carriage in the main scanning direction, a power source and a drive pulley that drive the carriage to move in the main scanning direction, a driven pulley that transmits the drive power from the power source to the carriage, and a motion transmitting element that is arranged over the drive pulley and the driven pulley. The carriage is forced toward the guide by a tension generated by deflecting an extending direction of the motion transmitting element.

14 Claims, 5 Drawing Sheets

IMAGING APPARATUS

BACKGROUND OF THE INVENTION

1. Field of the Invention

The present invention relates to an imaging apparatus such as an inkjet recording apparatus.

2. Description of the Related Art

An imaging apparatus may include a carriage that moves back and forth along the main scanning direction, plural recording heads arranged on the carriage that discharge ink, a guide member that guides the carriage in the main scanning direction, a power source for enabling the carriage to move in the main scanning direction, and a driven pulley and belt (or wire) for transmitting a drive force from the power source to the carriage. In such an imaging apparatus, imaging quality may be improved by preventing backlash of the carriage while it is being moved (i.e., while scanning operations are performed).

However, it has been quite difficult to prevent backlash of the carrier during scanning operations in a conventional imaging apparatus so that image quality degradation and noise generation have been a problem.

SUMMARY OF THE INVENTION

In one aspect of the present invention, an imaging apparatus is provided that is adapted to prevent a motion transmitting element such as a timing belt for driving the carriage from being disengaged from the carriage, reduce backlash of the carriage while it is being moved, improve imaging quality, and reduce noise generation, for example.

According to an embodiment of the present invention, an imaging apparatus is provided that includes:

a carriage that moves back and forth along a main scanning direction;

a plurality of recording heads mounted on the carriage which recording heads discharge recording liquid;

a guide that guides the carriage in the main scanning direction;

a power source and a drive pulley that drive the carriage to move in the main scanning direction;

a driven pulley that transmits drive power from the power source to the carriage; and a motion transmitting element that is arranged over the drive pulley and the driven pulley;

wherein the carriage is forced toward the guide by a tension generated by deflecting an extending direction of the motion transmitting element.

In one preferred embodiment, a distance between the drive pulley and the guide, denoted as L1, a distance between the driven pulley and the guide, denoted as L2, and a distance between the guide and a coupling point at which the carriage and the motion transmitting element are coupled, denoted as L3, satisfy the condition L1>L2>L3.

In another preferred embodiment, the distances L1, L2, and L3 satisfy the condition L1=L2>L3.

In another preferred embodiment, the distances L1, L2, and L3 satisfy the condition L2>L1>L3.

In another preferred embodiment, the distances L1, L2, and L3 satisfy the condition L2>L3>L1.

In another preferred embodiment, the distances L1, L2, and L3 satisfy the condition L1>L3>L2.

In another preferred embodiment, the distances L1, L2, and L3 satisfy the condition L3>L1>L2.

In another preferred embodiment, the distances L1, L2, and L3 satisfy the condition L3>L2>L1.

In another preferred embodiment, the carriage includes a coupling portion coupled with the motion transmitting element.

In another preferred embodiment, the motion transmitting element is supported by the drive pulley, the driven pulley, and the coupling portion to form a substantially triangular shape.

In another preferred embodiment, the carriage includes a plurality of coupling portions coupled with the motion transmitting element.

In another preferred embodiment, a forward moving position of the motion transmitting element and a backward moving position of the motion transmitting element are arranged to be substantially parallel.

In another preferred embodiment, the coupling portion includes a disengagement preventing element for preventing disengagement of the motion transmitting element from the coupling portion.

In another preferred embodiment, the motion transmitting element includes a disengagement preventing portion for preventing disengagement of the motion transmitting element from the coupling portion.

In another preferred embodiment, the coupling portion includes a pin that fixes the coupling portion to the motion transmitting element and prevents disengagement of the motion transmitting element from the coupling portion.

In another preferred embodiment, the coupling portion includes a plate spring that fixes the coupling portion to the motion transmitting element and prevents disengagement of the motion transmitting element from the coupling portion.

In another preferred embodiment, the motion transmitting element is a toothed timing belt.

In another preferred embodiment, the motion transmitting element is a metal wire.

DESCRIPTION OF THE PREFERRED EMBODIMENTS

In the following, preferred embodiments of the present invention are described with reference to the accompanying drawings. It is noted that in the examples described below, paper is used as a recording medium on which image formation operations are performed. However, the present invention is not limited to such an example, and image formation may be performed on other types of recording media such as an OHP. Also, it is noted that in the following descriptions, the term "ink" is used to refer to any type of recording liquid that may be used to form an image on some type of recording medium and is not limited to conventional ink that is typically used in a printer.

First Embodiment

Figure 1:
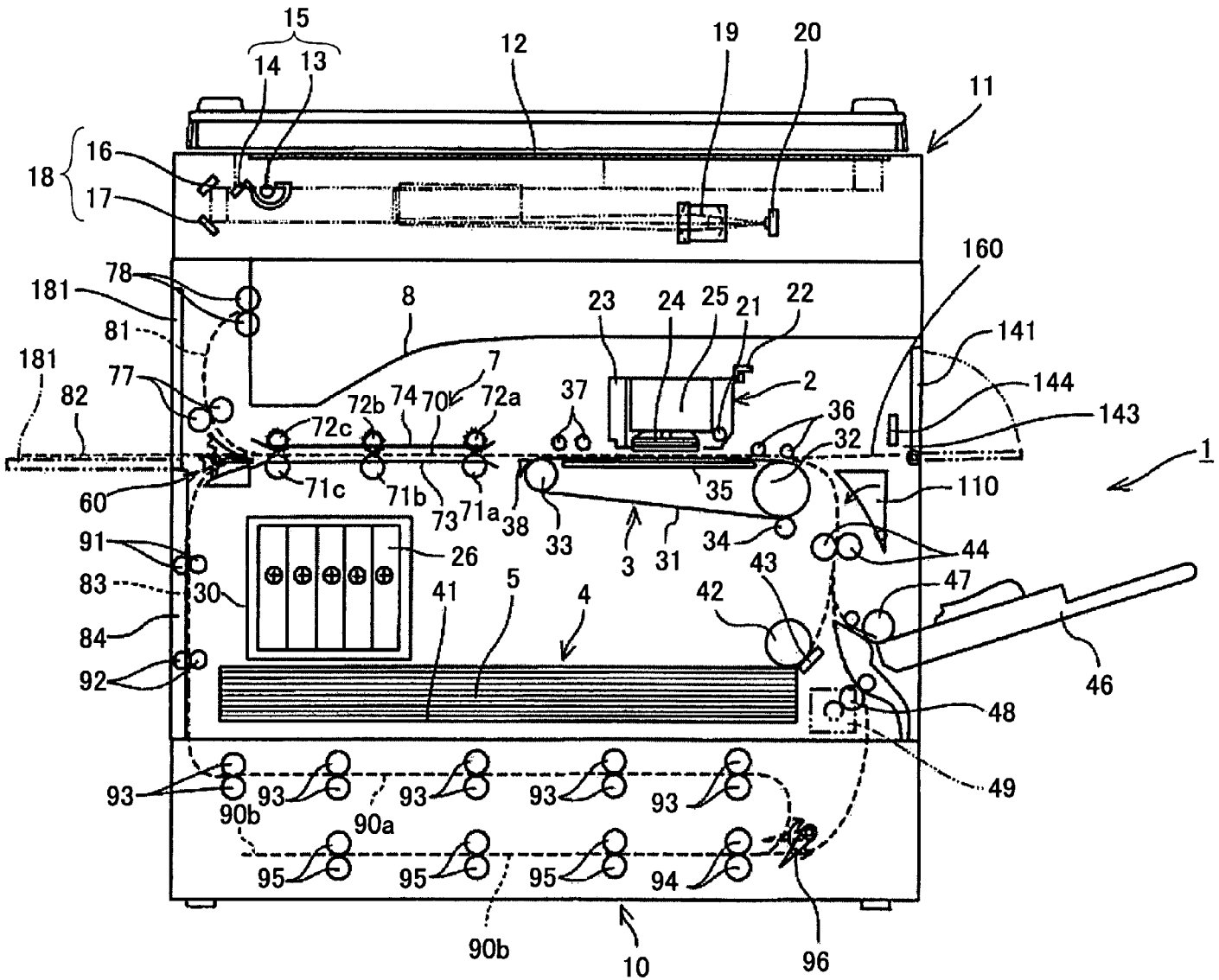
FIG. 1 is a diagram showing an overall configuration of an inkjet recording apparatus.
Figure 2:
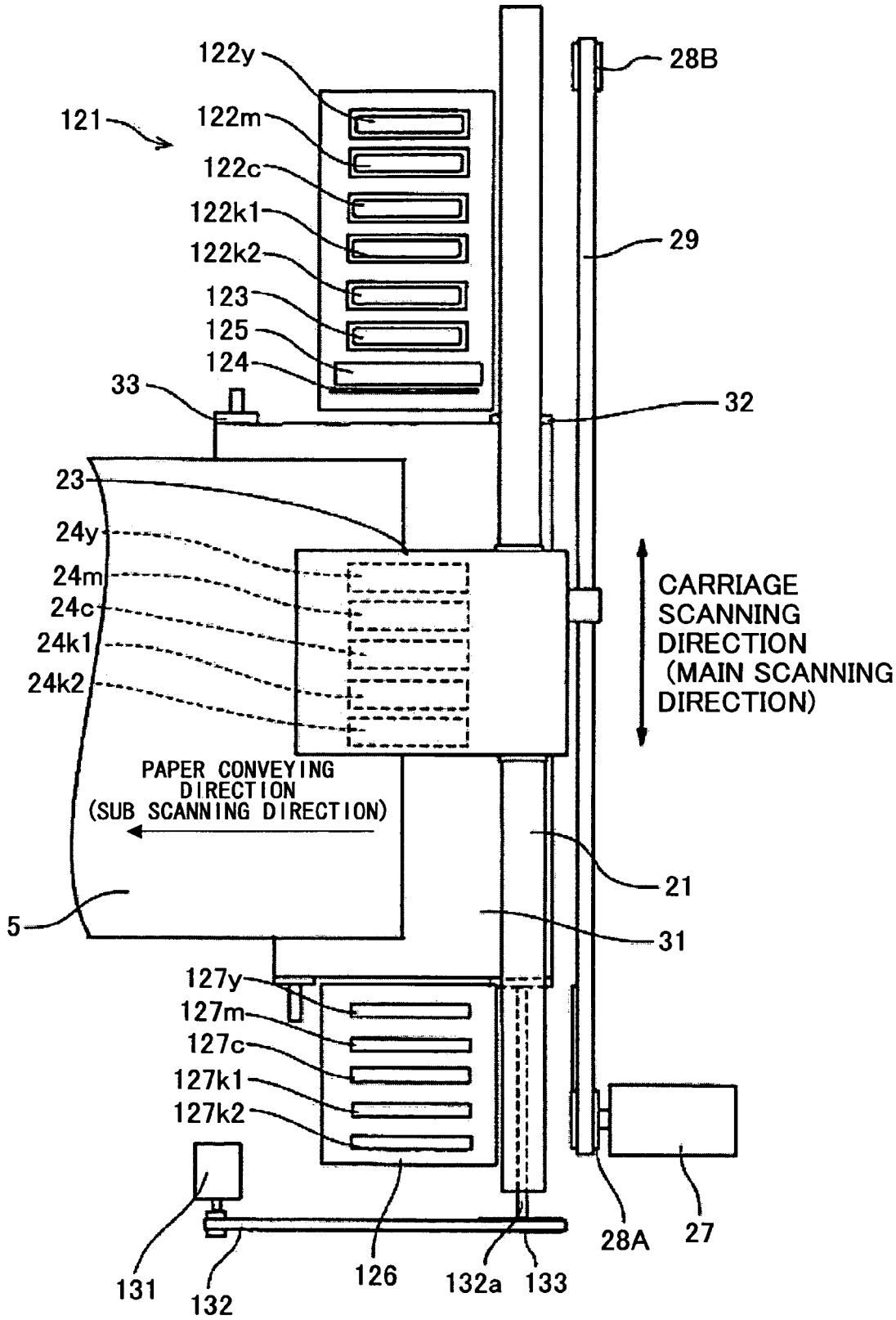
FIG. 2 is a diagram illustrating an image formation unit and a sub scanning conveying unit of the inkjet recording apparatus of FIG. 1.

FIG. 1 is a diagram showing a general configuration of an inkjet recording apparatus as an imaging apparatus according to an embodiment of the present invention. FIG. 2 is a plan view of an image forming unit and a sub scanning conveying unit of the inkjet recording apparatus shown in FIG. 1.

The inkjet recording apparatus of the present embodiment includes a main frame 1 inside which an image forming unit 2, a sub scanning conveying unit 3, and a paper feed unit 4 are arranged. The image forming unit 2 is configured to form an image on paper 5 that is conveyed by the sub scanning conveying unit 3. The sub scanning conveying unit 3 is configured to convey the paper 5 so that it moves facing the image forming unit 2. The paper feed unit 4 is arranged at the bottom portion of the main frame 1 and includes a paper feed cassette 41. In this inkjet recording apparatus, paper 5 is fed from the paper feed unit 4 to the sub scanning conveying unit 3 one sheet at a time, and is conveyed by the sub scanning conveying unit 3 to face the image forming unit 2. As the sub scanning conveying unit 3 conveys the paper 5 opposite the image forming unit 2, the image forming unit 2 discharges liquid droplets onto the paper 5 to form (record) a predetermined image thereon. Then, in single-side printing mode, the paper 5 is delivered to a paper delivery tray 8 that is arranged at the upper face of the main frame 1 via a paper delivery conveying unit 7. In dual-side printing mode, the paper delivery conveying unit 7 conveys the paper 5 to a dual-side printing unit 10 that is arranged at the bottom portion of the main frame 1 so that the paper 5 may be turned over (switched back) and fed once again to the sub scanning conveying unit 3. In this way, an image may be printed on both sides of the paper 5 after which the dual-side-printed paper 5 may be delivered to the paper delivery tray 8.

Also, in the illustrated inkjet recording apparatus, an image reading unit (scanner unit) 11 as an input system for inputting image data (print data) of the image to be formed by the image forming unit 2 is arranged at the upper portion of the main frame 1 above the delivery tray 8. In the image reading unit 11, a scanning optical system 15 including a light source 13 and a mirror 14, and a scanning optical system 18 including mirrors 16 and 17 are moved to read the image of a document placed on a contact glass 12. Then, the scanned document image is read as an image signal by an image reading element 20 that is disposed on the rear side of a lens 19. The read image signal is then digitally processed into print data so that the digital print data may cause an image to be printed.

In one embodiment, the input system for inputting image data (print data) of an image to be recorded by the image forming unit 2 of the inkjet recording apparatus may be configured to receive image data including relevant print data from an external host apparatus such as an information processing apparatus (e.g., personal computer), an image reading apparatus (e.g., image scanner), or an image capturing apparatus (e.g., digital camera) via a cable or a network, after which the received print data may be processed and an image printed by the inkjet recording apparatus.

As is shown in FIG. 2, the image forming unit 2 includes a carriage 23 that is supported by a guide rod 21 and a guide stay (not shown) and is capable of moving in the main scanning direction, and a main scanning drive mechanism that drives the carriage 23 to move in the main scanning direction by means of a main scanning motor 27 that moves a timing belt 29 that is arranged around a drive pulley 28A and a driven pulley 28B.

The carriage 23 has plural recording heads 24 with liquid discharge heads for discharging droplets of inks in various colors. In the illustrated embodiment, shuttle image formation operations are performed where the carriage 23 is moved in the main scanning direction, and the recording heads 24 are arranged to discharge droplets of ink while the paper 5 is conveyed in the paper conveying direction (sub scanning direction) by the sub scanning conveying unit 3.

Also, in the illustrated embodiment, the recording heads 24 comprise five liquid discharge heads, namely, two liquid discharge heads 24*k*1 and 24*k*2 that discharge black (Bk) ink, and liquid discharge heads 24*c*, 24*m*, and 24*y* that discharge cyan (C) ink, magenta (M) ink, and yellow (Y) ink, respectively. It is noted that the liquid discharge heads 24*k*1, 24*k*2, 24*c*, 24*m*, and 24*y* may simply be referred to as "recording heads 24" hereinafter when their distinctions are not particularly relevant. Also, the carriage 23 has plural sub tanks 25 mounted thereon for supplying corresponding inks to the recording heads 24.

In the illustrated apparatus of FIG. 1, ink cartridges 26 as recording liquid cartridges containing black (B) ink, cyan (C) ink, magenta (M) ink, and yellow (Y) ink may be installed in or removed from a cartridge installing unit 30 from the front face of the main frame 1. The ink cartridges 26 are configured to supply ink to corresponding sub tanks 25. In one embodiment, black ink is supplied to two sub tanks 25 from one ink cartridge 26.

It is noted that the recording head 24 may correspond to a so-called piezo head that uses a piezoelectric element as pressure generating means (actuator means) for pressurizing ink within an ink flow path (pressure generating chamber) to deform a vibrating plate comprising a wall of the ink flow path and change the internal shape (volume) of the ink flow path so that ink droplets may be discharged, for example. Also, the recording head 24 may correspond to a so-called thermal head that uses a thermal resistor to heat the ink within the ink flow path and cause formation of air bubbles so that ink droplets may be discharged by the resulting pressure from such air bubble formation, for example. Further, the recording head 24 may correspond to a so-called electrostatic head that has an electrode and a vibrating plate comprising a wall of the ink flow path facing each other to cause the vibrating plate to be deformed by an electrostatic force that is generated between the vibrating plate and the electrode so that the internal shape (volume) of the ink flow path may be changed and ink droplets may be discharged, for example.

In the illustrated example of FIG. 2, a maintenance/restoration unit 121 for maintaining and restoring the nozzles of the recording heads 24 is arranged at an non-printing region on one side along the scanning direction of the carriage 23 (main scanning direction). The maintenance/restoration unit 121 includes five protective caps 122*k*2, 122*k*1, 122*c*, 122*m*, and 122*y* (simply referred to as "protective caps 122" hereinafter when their distinctions are not relevant) for covering and protecting the nozzle surfaces of the five recording heads 24, a suction cap 123, a wiper blade 124 for wiping the nozzle surfaces of the recording heads 24, and an idle discharge receiving member 125 for enabling the recording heads 24 to perform liquid droplet idle discharge operations unrelated to recording (image formation) operations, for example.

Also, in FIG. 2, an idle discharge receiving member 126 for enabling the recording heads 24 to perform liquid droplet idle discharge operations unrelated to recording (image formation) operations is arranged at a non-printing region on the other side along the scanning direction of the carriage 23 (main scanning direction). The idle discharge receiving member 126 has five openings 127*k*2, 127*k*1 127*c*, 127*m*, and 127*y* (simply referred to as "openings 127" hereinafter when their distinctions are not relevant) corresponding to the five recording heads 24.

The sub scanning conveying unit 3 includes a conveying belt 31 arranged around a conveying roller 32 corresponding to a drive roller and a driven roller 33 corresponding to a tension roller. The conveying belt 31 is configured to turn the conveying direction of paper 5 fed from the paper feed unit 4 by approximately 90 degrees to direct the paper 5 to face the image forming unit 2 and convey the paper 5 in this position. The sub scanning conveying unit 3 also includes a charge roller 34 for charging the surface of the conveying belt 31. The charge roller 34 is charged by a high voltage power source to have a high alternating voltage. The sub scanning conveying unit 3 also includes a guide member 35 that guides a portion of the conveying belt 31 that is facing the image forming unit 2, two pressure rollers 36 that press the paper 5 onto the conveying belt 31 at positions opposite the conveying roller 32, two spur rollers 37 that press the upper face of the paper 5 having an image formed thereon, and a separating piece 38 for separating the paper 5 carrying the recorded image from the conveying belt 31.

The paper feed unit 4 may be detachably installed inside the main frame 1 from the front face side of the main frame 1, and includes a paper feed cassette 41 that stacks and accommodates plural sheets of paper 5, a paper feed roller 42 and a friction pad 43 for separating and discharging one sheet of the paper 5 at a time from the paper feed cassette 41, and resist rollers 44 for resisting the paper 5 being fed. Also, the paper feed unit 4 includes a manual feed tray 46 for stacking and accommodating plural sheets of paper 5, a manual feed roller 47 for feeding the paper 5 stacked on the manual feed tray 46 one sheet at a time, and a pair of conveying rollers 48 for conveying the paper 5 fed from the dual side printing unit 10 or an optional paper feed cassette arranged at the bottom side of the main frame 1. It is noted that members for feeding the paper 5 to the sub scanning conveying unit 3 such as the paper feed roller 42, the resist roller 44, the manual feed roller 47, and the conveying rollers 48 are driven and rotated by a paper feed motor 49 that includes an HB stepping motor via an electromagnetic clutch (not shown).

The paper delivery unit 7 includes three conveying rollers 71*a*, 71*b*, and 71*c* (simply referred to as "conveying rollers 71" when their distinctions are not relevant), spurs 72*a*, 72*b*, and 72*c* that oppose the corresponding conveying rollers 71 (simply referred to as "spurs 72" when their distinctions are not relevant), a lower guide member 73 and an upper guide member 74 that guide the paper 5 conveyed through the conveying rollers 71 and the spurs 72, and a pair of reversing rollers 77 and a pair of reversing/paper delivery rollers 78 for reversing the paper 5 guided by the lower guide member 73 and the upper guide member 74 by passing the paper 5 through a first paper delivery path 81 so that the paper 5 may be delivered onto the paper delivery tray 8 with the printed side facing downward. It is noted that a conveying path 70 defined by the lower guide member 73 and the upper guide member 74 is arranged to have an adequate distance for enabling an image formed on the paper 5 to dry before being reversed so that the image formed on the paper 5 may not be scratched or damaged upon being reversed and delivered via the first paper delivery path 81.

Also, it is noted that a switch mechanism 60 is arranged at the exit side of the conveying path 70 for switching between conveying the paper 5 to the first paper delivery path 81 for reversing and delivering the paper 5 to the paper delivery tray 8, a second paper delivery tray 82 for delivering the paper 5 to a straight paper delivery tray 181, and a dual-side printing paper delivery path 83 for conveying the paper 5 to the dual-side printing unit 10.

The dual-side printing paper delivery path 83 is vertically arranged at one side of the main frame 1 and is configured to receive the paper 5 from the switch mechanism 60 and convey the paper 5 downward to the dual printing unit 10. The vertical dual-side printing paper delivery path 83 includes a pair of entrance rollers 91 and a pair of exit rollers 92 for conveying the paper in the downward direction. Also, a guide plate 84 is arranged at the side of the main frame 1 for defining the vertical dual-side printing paper delivery path 83.

The dual-side printing unit 10 includes a horizontal conveying path 90*a* and a switchback conveying path 90*b*. The horizontal conveying path 90*a* includes five pairs of dual-side conveying rollers 93, and the switchback conveying path 90*b* includes a pair of dual-side reversing rollers 94 and three pairs of dual-side rollers 95.

Also, the dual-side printing unit 10 includes a slidable switch plate 96 for switching between conveying the paper 5 from the horizontal conveying path 90*a* to the switchback conveying path 90*b*, and feeding the paper 5 from the switchback conveying path 90*b* to the conveying rollers 48. The switch plate 96 is configured to slide from a switchback position indicated by a solid line in FIG. 1 to a paper feed position indicated by a broken line in FIG. 1 and vice versa.

The paper 5 discharged from the dual-side printing unit 10 is conveyed through the conveying rollers 48 and the resist rollers 44. The paper 5 that is being fed to the sub scanning conveying unit 3 from the dual-side printing unit 10, the manual paper feed tray 46, or the paper feed cassette 41 of the paper feed unit 4 is conveyed through the resist rollers 44. As is shown in FIG. 1, a slidable open/close guide plate 110 is arranged between the position of the conveying roller 32 and the press roller 36 of the sub scanning conveying unit 3 and the position of the resist rollers 44, the open/close guide plate 110 being configured to control a portion of the paper 5 held between these positions to form a loop (relaxed portion) so as to reduce back tension (compression) on the paper 5.

When the paper 5 is conveyed from the rollers 44 to the sub scanning conveying unit 3, the open/close guide plate 110 is slid through an arc in the direction indicated by the arrow shown in FIG. 1 to guide the paper 5. Then, the open/close guide plate 110 is slid back to its original position when the paper 5 reaches the sub scanning conveying unit 3 to enable loop formation of the paper 5.

It is noted that in the illustrated inkjet recording apparatus of FIG. 1, a manual single-sheet feed tray 141 for enabling manual feeding of a single sheet of paper is arranged at one side of the main frame 1. The manual single-sheet feed tray 141 is configured to open and close with respect to the main frame 1; that is, the manual single-sheet feed tray 141 is opened to the position indicated by the broken line in FIG. 1 when a single sheet of paper is to be manually fed. The paper 5 manually fed via the manual single-sheet feed tray 141 may be guided across the upper face of the open/close guide plate 110 to be linearly inserted through the conveying roller 32 and the press roller 36 of the sub scanning conveying unit 3.

Also, the straight paper delivery tray 181 is arranged at the other side of the main frame 1 for delivering the paper 5 with the image-printed side facing upward. The straight paper delivery tray 181 is configured to open and close with respect to the main frame 1. By opening the straight paper delivery tray 181, a second paper delivery path (straight paper delivery path) 82 is formed for linearly delivering the paper 5 conveyed by the lower guide member 73 and the upper guide member 74 of the paper delivery unit 7 to the straight paper delivery tray 181.

It is noted that the manual single-sheet feed tray 141 and the straight paper delivery tray 181 may be suitably used in a case where OHP or thick paper that cannot be easily bent and reversed is used as the paper 5. In such a case, the paper 5 may be conveyed in a linear manner from the manual single-sheet feed tray 141 to the straight paper delivery tray 181. However, normal paper may also be fed from the manual single-sheet feed tray 141 and delivered to the straight paper delivery tray 181 through a liner path in a similar manner.

In the following, image formation operations of the illustrated inkjet recording apparatus of the present embodiment are described. When a negative-positive rectangular wave alternating high voltage is applied to the charge roller 34 from an AC bias supply unit (not shown), since the charge roller 34 is in contact with the insulating layer (surface layer) of the conveying belt 31, negative and positive potentials are alternatingly applied to the surface layer of the conveying belt 31 at predetermined width intervals with respect to the conveying direction so that non-uniform electric fields are generated.

Then, when paper 5 is fed from the paper feed casette 41, the manual paper feed unit 46, the dual-side printing unit 10, or the manual single-sheet feed tray 141 to be conveyed through the conveying roller 32 and the press rollers 36 onto the conveying belt 3 where non-uniform electric fields are generated by positive and negative charges, the paper 5 is immediately polarized according to the orientation of the electric fields and is adhered to the surface of the conveying belt 31 by electrostatic attraction force to be conveyed in accordance with the movement of the conveying belt 31.

The paper 5 on the conveying belt 31 is intermittently moved, and droplets of recording liquid are discharged from the recording heads 24 onto the paper 5 according to print data so that an image may be formed (printed) thereon. Then, the front edge of the paper 5 having the image formed thereon is separated from the conveying belt 31 by the separating piece 38 so that the paper 5 may be delivered to the paper delivery tray 8 or the straight paper delivery tray 181 by the paper delivery unit 7, or conveyed to the dual-side printing unit 10 to have an image printed on its other side.

Figure 3A:
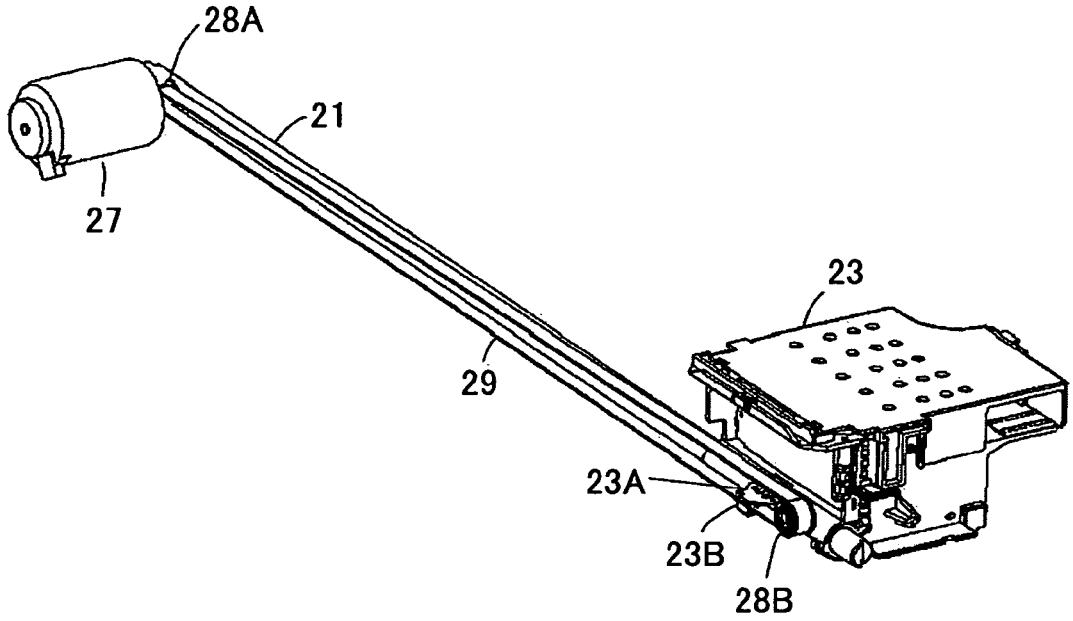
FIGS. 3A and 3B are diagrams illustrating a carriage and a main scanning drive mechanism according to a first embodiment of the present invention.
Figure 3B:
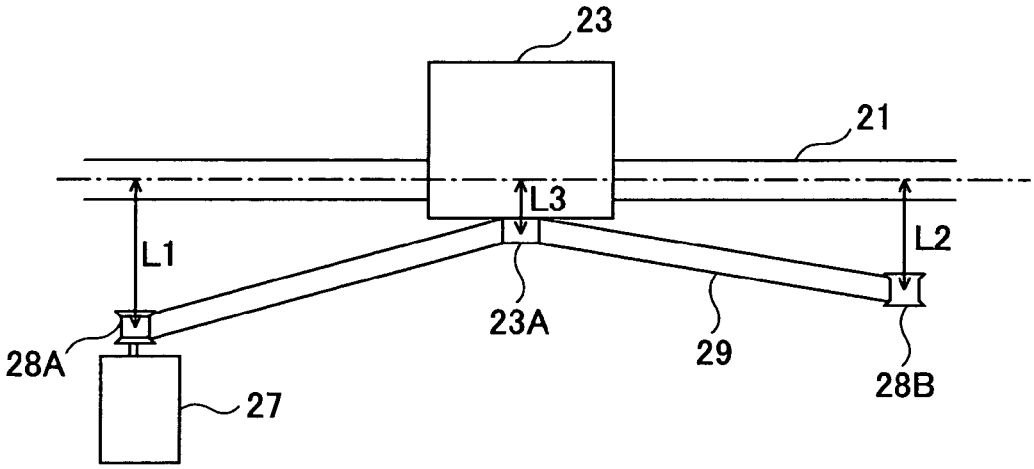

FIGS. 3A and 3B are diagrams showing configurations of the carriage 23 and the main scanning drive mechanism according to a first embodiment of the present invention. Specifically, FIG. 3A is a perspective view and FIG. 3B is a plan view of the carriage 23 and the main scanning drive mechanism. As is described above, the carriage 23 is supported by a guide rod 21 and a guide stay (not shown) so that it may move in the main scanning direction, and the main scanning drive mechanism drives the carriage 23 in the main scanning direction by a main scanning motor 27 corresponding to a drive motor via a timing belt 29 that is wound around a drive pulley 28A and a driven pulley 28B. The carriage 23 has a coupling portion 23A for coupling the carriage 23 to the timing belt 29, the coupling portion 23A extending in an orthogonal direction with respect to the lengthwise direction of the timing belt 29. The coupling portion 23A has a protrusion 23B that protrudes downward from the tip of the coupling portion 23A. The protrusion 23B is configured to catch the lower side of the timing belt 29 that forms a loop around the drive pulley 28A and the driven pulley 28B and pull the timing belt 29 toward the carriage 23 side as is shown in FIG. 3B. By deflecting the extending direction of the timing belt 29 in this manner, the carriage 23 may be forced into adequate contact with the guide rod 21 by the tension generated by the deflection of the timing belt 29. Thus, the carriage 23 may be moved while being forced into close contact with the guide rod 21. In this way, backlash of the carriage 23 may be prevented while it is being moved back and forth in the main scanning direction.

Also, in one preferred embodiment, the distance between the drive pulley 28A and the guide rod 21 (i.e., the distance between the centers thereof), denoted as L1, the distance between the driven pulley 28B and the guide rod 21 (i.e., the distance between the centers thereof), denoted as L2, and the distance between the carriage 23 and the coupling point with the timing belt 29 (i.e., distance between the coupling portion 23A and the guide rod 21), denoted as L3, may be designed to satisfy the condition L1>L2>L3 in order to prevent the timing belt 29 from being disengaged from the coupling portion 23A. In this way, image quality may be improved and noise generation may be reduced in image formation operations.

It is noted that FIG. 3B is a slightly exaggerated illustration of the above preferred embodiment. However, the present invention is not limited to this embodiment, that is, the dimensional relation between the distances L1, L2, and L3 is not limited to satisfying the above condition. For example, the inventor of the present invention was able to obtain satisfactory results from testing an apparatus having dimensions L1=approximately 10 mm, L2=approximately 10 mm, and L3=8 mm (i.e., L1=L2>L3). In addition to the conditions L1=L2>L3 and L1>L2>L3 described above, the dimensions L1, L2, and L3 may be designed to satisfy other conditions such as L2>L1<L3, L2>L3>L1, L1>L3>L2, L3>L1>L2, or L3>L2>L1.

Second Embodiment

Figure 4:
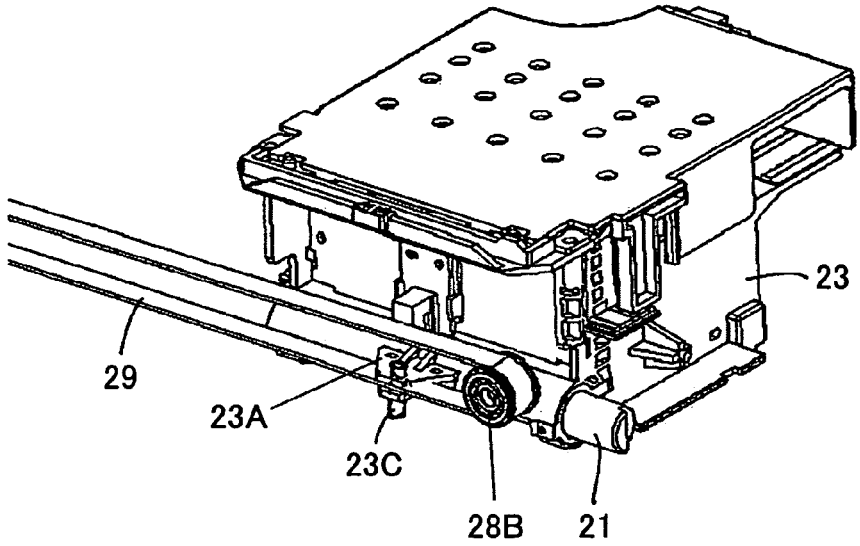
FIG. 4 is a diagram illustrating the engagement of a carriage and a timing belt according to a second embodiment of the present invention.

FIG. 4 is a diagram showing a modified configuration of the coupling portion 23A for coupling the carriage 23 to the timing belt 29 according to a second embodiment of the present invention. The coupling portion 23A according to the present embodiment has two triangular plates extending from the carriage 23 to cover the upper and lower faces of the timing belt 29, and a pin 23C that penetrates through the tip portions of the two triangular plates and the timing belt 29 to fix the carriage 23 to the timing belt 29. It is noted that the pin 23C does not necessarily have to penetrate through the timing belt 29 as long as the timing belt 29 may be adequately fixed by the pin 23C. Other features of the second embodiment may be identical to those of the first embodiment, and therefore, their descriptions are omitted.

Third Embodiment

Figure 5:
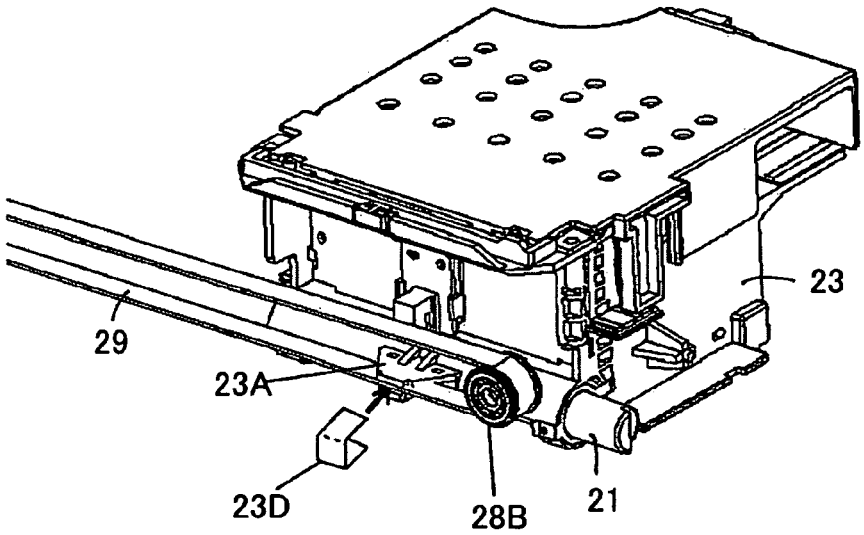
FIG. 5 is a diagram illustrating the engagement of a carrier and a timing belt according to a third embodiment of the present invention.

FIG. 5 is a diagram illustrating another modified configuration of the coupling portion 23A for coupling the carriage 23 to the timing belt 29 according to a third embodiment of the present invention. The coupling portion 23A according to the present embodiment has two triangular plates extending from the carriage 23 to cover the upper and lower faces of the timing belt 29, and a clip-shaped plate spring 23D that engages the tip portions of the triangular plates to fix the carriage 23 to the timing belt 29. It is noted that other features of the third embodiment may be identical to those of the first embodiment, and therefore, their descriptions are omitted.

Fourth Embodiment

Figure 6:
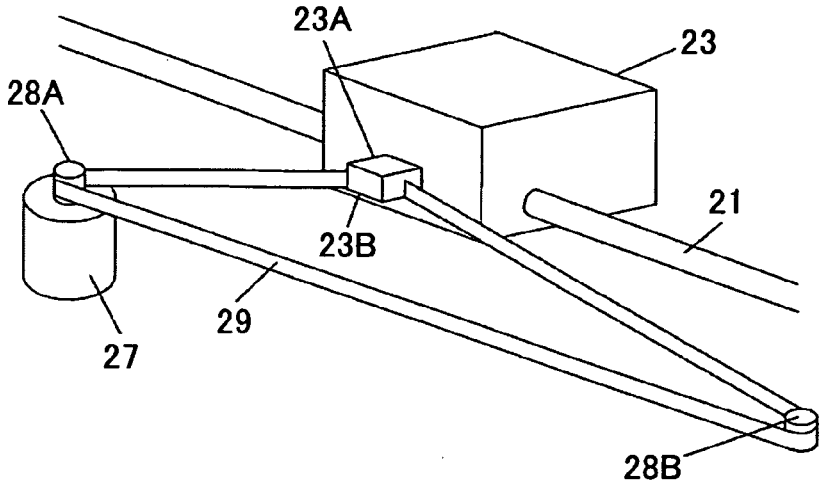
FIG. 6 is a diagram illustrating the engagement of a carrier and a timing belt according to a fourth embodiment of the present invention.

FIG. 6 is a diagram showing a modified configuration of the timing belt 29 according to a fourth embodiment of the present invention. According to the present embodiment, the disposition of the timing belt 29 is rotated by 90 degrees, and in turn, the dispositions of the main scanning motor 27, the drive pulley 28A, and the driven pulley 28B are also altered. It is noted that the present embodiment with the altered timing belt 29 may be suitably used in certain imaging apparatuses (inkjet recording apparatuses) depending on their internal configurations. Other features of the fourth embodiment may be identical to those of the first embodiment, and therefore, their descriptions are omitted.

Fifth Embodiment

Figure 7:
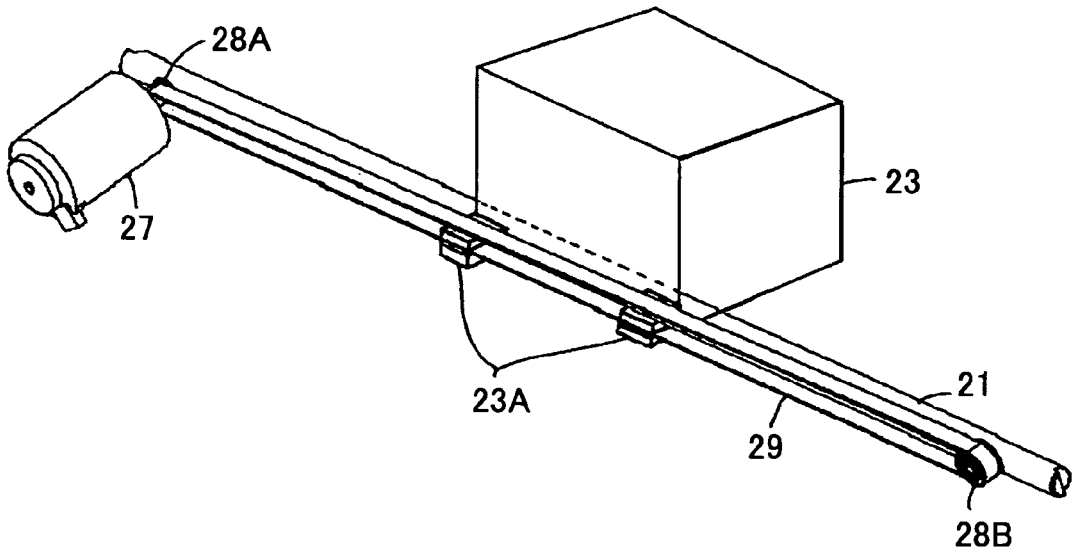
FIG. 7 is a diagram illustrating the engagement of a carrier and a timing belt according to a fifth embodiment of the present invention.

FIG. 7 is a diagram illustrating a modified configuration of the coupling portion 23A for coupling the carriage 23 to the timing belt according to a fifth embodiment of the present invention. According to the present embodiment, the carriage 23 has two coupling portions 23A protruding from the side edges of the carriage 23 in an orthogonal direction with respect to the lengthwise direction of the timing belt 29. The two coupling portions 23A are secured to the timing belt 29 at two corresponding locations. With such an arrangement, the carriage 23 may be held at a substantially parallel position between the two coupling portions 23A so that the upper and lower sides of the loop formed by the timing belt 29 may be substantially parallel to each other while the timing belt 29 is being moved. In the illustrated example of FIG. 7, the drive pulley 28A and the driven pulley 28B are diagonally oriented to each other so that the carriage 23 may be easily coupled to the timing belt 29. It is noted that such an arrangement may be made in the other previously-described embodiments as well. Also, the number of coupling portions 23A is not limited to two, and three or more coupling portions 23A may be used to couple the carrier 23 to the timing belt 29 in other alternative embodiments.

It is noted that in the above-described embodiments, a toothed timing belt is used as a motion transmitting element. However, the present invention is not limited to use of such a timing belt. For example, other types of belts, chains, or metal wires may be used in alternative embodiments. In selecting a suitable motion transmitting element, factors related to elongation or stretching of the motion transmitting element upon motion transmission are preferably taken into consideration.

As can be appreciated, in an imaging apparatus according to an embodiment of the present invention that includes a carriage that moves back and forth along the main scanning direction, plural recording heads for discharging ink that are mounted on the carriage, a guide that guides the carriage in the main scanning direction, a power source and a drive pulley that drive the carriage to move in the main scanning direction, a driven pulley that transmits the drive power from the power source to the carriage, and a motion transmitting element that is arranged over the drive pulley and the driven pulley, the carriage is forced toward the guide by the tension generated by deflecting the extending direction of the motion transmitting element so that backlash of the carriage may be prevented while it is moving back and forth in the main scanning direction. It is noted that a belt, a chain, or some other suitable motion transmitting mechanism may be used as the motion transmitting element.

Also, it is noted that applications of the present invention is not limited to the imaging apparatus as is illustrated in FIGS. 1 and 2, and may also be applied to other various types of imaging apparatuses.

Although the present invention is shown and described with respect to certain preferred embodiments, it is obvious that equivalents and modifications may occur to others skilled in the art upon reading and understanding the specification. The present invention includes all such equivalents and modifications, and is limited only by the scope of the claims.

The present application is based on and claims the benefit of the earlier filing date of Japanese Patent Application No. 2005-347458 filed on Dec. 1, 2005, the entire contents of which are hereby incorporated by reference.

What is claimed is:

1. An imaging apparatus comprising:

a carriage that moves back and forth along a main scanning direction;

a plurality of recording heads mounted on the carriage which recording heads discharge recording liquid;

a guide that guides the carriage in the main scanning direction;

a power source and a drive pulley that drive the carriage to move in the main scanning direction;

a driven pulley that transmits drive power from the power source to the carriage; and a motion transmitting element that is arranged over the drive pulley and the driven pulley;

wherein the carriage is forced toward the guide by a tension generated by deflecting an extending direction of the motion transmitting element, and a distance between the drive pulley and the guide, denoted as L1, a distance between the driven pulley and the guide, denoted as L2, and a distance between the guide and a coupling point at which the carriage and the motion transmitting element are coupled, denoted as L3, satisfy any one of conditions:

$L1>L2>L3$;

$L1=L2>L3$;

$L2>L1>L3$;

$L2>L3>L1$;

$L1>L3>L2$;

$L3>L1>L2$; and $L3>L2>L1$.

2. The imaging apparatus as claimed in claim 1, wherein the carriage includes a coupling portion coupled with the motion transmitting element.

3. The imaging apparatus as claimed in claim 2, wherein a number of the coupling portion included in the carriage and coupled with the motion transmitting element is plural.

4. The imaging apparatus as claimed in claim 3, wherein a forward moving position of the motion transmitting element and a backward moving position of the motion transmitting element are arranged to be substantially parallel.

5. The imaging apparatus as claimed in. claim 2, wherein the coupling portion includes a disengagement preventing element for preventing disengagement of the motion transmitting element from the coupling portion.

6. The imaging apparatus as claimed in claim 2, wherein the motion transmitting element includes a disengagement preventing portion for preventing disengagement of the motion transmitting element from the coupling portion.

7. The imaging apparatus as claimed in claim 2, wherein the coupling portion includes a pin that fixes the coupling portion to the motion transmitting element and prevents disengagement of the motion transmitting element from the coupling portion.

8. The imaging apparatus as claimed in claim 2, wherein the coupling portion includes a plate spring that fixes the coupling portion to the motion transmitting element and prevents disengagement of the motion transmitting element from the coupling portion.

9. The imaging apparatus as claimed in claim 1, wherein the motion transmitting element is a toothed timing belt.

10. The imaging apparatus as claimed in claim 1, wherein the motion transmitting element is a metal wire.

11. An imaging apparatus, comprising:

a carriage that moves back and forth along a main scanning direction;

a plurality of recording heads mounted on the carriage which recording heads discharge recording liquid;

a guide that guides the carriage in the main scanning direction;

a power source and a drive pulley that drive the carriage to move in the main scanning direction;

a driven pulley that transmits drive power from the power source to the carriage; and a motion transmitting element that is arranged over the drive pulley and the driven pulley;

wherein the carriage is forced toward the guide by a tension generated by deflecting an extending direction of the motion transmitting element, and wherein the motion transmitting element is supported by the drive pulley, the driven pulley, and a coupling portion at which the carriage and the motion transmitting element are coupled to form a substantially triangular shape.

12. An imaging apparatus comprising:

a carriage that moves back and forth along a main scanning direction;

a plurality of recording heads mounted on the carriage which recording heads discharge recording liquid;

a guide that guides the carriage in the main scanning direction;

a power source and a drive pulley that drive the carriage to move in the main scanning direction;

a driven pulley that transmits drive power from the power source to the carriage; and a motion transmitting element that is arranged over the drive pulley and the driven pulley;

wherein the carriage is forced in an orthogonal direction with respect to a lengthwise direction of the motion transmitting element toward the guide by a tension generated by deflecting an extending direction of the motion transmitting element.

13. The imaging apparatus as claimed in claim 12, wherein the carriage include a coupling portion to couple the carriage to the motion transmitting element, and the coupling portion extends in an orthogonal direction with respect to the lengthwise direction of the motion transmitting element.

14. The imaging apparatus as claimed in claim 12, wherein the coupling portion is configured to pull the motion transmitting element towards the carriage, to deflect the extending direction of the motion transmitting element.

* * * * *